US008342233B2

(12) United States Patent
Kjellerstedt et al.

(10) Patent No.: US 8,342,233 B2
(45) Date of Patent: Jan. 1, 2013

(54) COOLING BEAM WITH VAV-FUNCTION VIA A REGULATING STRIP

(75) Inventors: Jonas Kjellerstedt, Norrahammar (SE); Hardy Johansson, Habo (SE); Robert Holgersson, Jonkoping (SE)

(73) Assignee: Flakt Woods AB, Jonkoping (SE)

( * ) Notice: Subject to any disclaimer, the term of this patent is extended or adjusted under 35 U.S.C. 154(b) by 0 days.

(21) Appl. No.: 13/148,858

(22) PCT Filed: Aug. 20, 2010

(86) PCT No.: PCT/SE2010/000207

§ 371 (c)(1),
(2), (4) Date: Aug. 10, 2011

(87) PCT Pub. No.: WO2011/040853

PCT Pub. Date: Apr. 7, 2011

(65) Prior Publication Data

US 2012/0216986 A1 Aug. 30, 2012

(30) Foreign Application Priority Data

Oct. 2, 2009 (SE) ..... 0901265

(51) Int. Cl.

| | |
|---|---|
| ***F24H 3/00*** | (2006.01) |
| ***F24H 9/06*** | (2006.01) |
| ***F25B 29/00*** | (2006.01) |
| ***F24F 3/00*** | (2006.01) |
| ***F24D 5/10*** | (2006.01) |

(52) U.S. Cl. ..... 165/47; 165/48.1; 165/50; 165/53; 165/55; 165/59; 454/347; 454/348

(58) Field of Classification Search ..... 165/47, 165/48.1, 50, 53, 54, 55, 58, 59; 454/108, 454/187, 347, 348, 358, 367
See application file for complete search history.

(56) References Cited

U.S. PATENT DOCUMENTS

| | | | | | |
|---|---|---|---|---|---|
| 2,651,250 | A | * | 9/1953 | Marquardt | 454/108 |
| 2,929,154 | A | * | 3/1960 | Finnegan | 454/180 |
| 3,057,286 | A | * | 10/1962 | Collins | 454/180 |
| 3,363,532 | A | * | 1/1968 | Horneff | 454/187 |
| 3,625,134 | A | * | 12/1971 | Smith | 52/199 |
| 3,726,204 | A | * | 4/1973 | Lindestrom | 454/187 |
| 3,817,160 | A | * | 6/1974 | Searcy et al. | 454/188 |
| 3,824,909 | A | * | 7/1974 | Horneff et al. | 454/187 |
| 3,975,995 | A | * | 8/1976 | Shuler | 454/187 |
| 4,094,232 | A | * | 6/1978 | Howorth | 454/187 |
| 4,170,930 | A | * | 10/1979 | Lind | 454/297 |

(Continued)

FOREIGN PATENT DOCUMENTS

EP 1 188 992 A2 3/2002

(Continued)

*Primary Examiner* — Ljiljana Ciric
(74) *Attorney, Agent, or Firm* — Davis & Bujold, PLLC

(57) ABSTRACT

A device for an air handling system in which the cooling beam has a pressure chamber (2), from which the volume flow of the supply air (L1) out to the room is regulated with a regulating strip (6) that is mounted on the surfaces (9) in the pressure chamber and where the flow of the supply air (L1), in the mixing chamber (4), provides an optimal flow pattern of the recirculating air (L2) from the room and where the combined flow of supply air (L1) and recirculating air (L2) acquire well defined flow profiles independent from the volume flow (L1).

8 Claims, 4 Drawing Sheets

U.S. PATENT DOCUMENTS

| | | | | |
|---|---|---|---|---|
| 4,316,406 | A * | 2/1982 | Lind | 454/284 |
| 4,537,118 | A * | 8/1985 | Lind | 454/284 |
| 4,747,341 | A * | 5/1988 | Hedrick | 454/187 |
| 5,263,290 | A * | 11/1993 | Gardner | 165/53 |
| 5,669,179 | A * | 9/1997 | Hanlon | 49/64 |
| 6,572,468 | B1 * | 6/2003 | Sasaki et al. | 454/187 |
| 6,574,937 | B1 * | 6/2003 | Rapisarda et al. | 52/126.6 |
| 6,612,084 | B2 * | 9/2003 | Rapisarda et al. | 52/630 |
| 6,715,538 | B2 | 4/2004 | Horttanainen et al. | |
| 6,817,941 | B1 * | 11/2004 | Gatov | 454/187 |
| 7,086,740 | B2 * | 8/2006 | Sample et al. | 454/358 |
| 2007/0164124 | A1 | 7/2007 | Juslin et al. | |

FOREIGN PATENT DOCUMENTS

| | | | |
|---|---|---|---|
| FI | 20060035 | A | 7/2007 |
| SE | 523 292 | C2 | 4/2004 |
| WO | 02/42691 | A1 | 5/2002 |
| WO | 03/027577 | A1 | 4/2003 |

* cited by examiner

COOLING BEAM WITH VAV-FUNCTION VIA A REGULATING STRIP

This application is a National Stage completion of PCT/SE2010/000207 filed Aug. 20, 2010, which claims priority from Swedish patent application serial no. 0901265-9 filed Oct. 2, 2009.

FIELD OF THE INVENTION

Present invention relates to a cooling beam with VAV-function to supply cooled or heated supply air to a room, especially an air handling system. In a complete air handling system especially designed cooling beams are often included which contains functions that leads to that the room air quality is secured by selected criteria like for example temperature, $CO_2$-level or load level in the room in which the specific cooling beam is mounted. The general comprehensive term for such a product is cooling beam, but it doesn=t exclude that it is also possible to heat the room air with the same, which then is a combined cooling beam for cooling as well as for heating. There can also, depending on the load, be necessary to change the air flow to the room, and in that case so called VAV-solutions (Variable Air Volume) are used.

BACKGROUND OF THE INVENTION

In the constructions that today exists in the sector of air handling there are solutions where the supply air to a room often is supplied via a cooling beam. In such a cooling beam the supply air is supplied to the room, at the same time as a certain room air volume is sucked, through the effect of induction, into the baffle, through a cooling or heating coil and is thereby usually cooled or heated in the same.

How this mixing of supply air and recirculated room air, which flows through the cooling beam, take place depends on how the cooling beam is designed. There are a number of known solutions to this.

Common for the solutions is that the ratio between both air quantities, between supply air versus recirculating room air is controlled, so that a desired air quality is obtained in the room in which the actual cooling beam is mounted, or in a room which can include several cooperating cooling beams.

Examples of known solutions are described in WO 02/42691 A1, where the inlet air device includes an inlet air chamber (11) where several nozzles (12*a*1, 12*a*2-12*b*1, 12*b*2—) or a discharge opening exists and where an induction ratio device (15) is placed and where this device controls the combined air flow (L1+L2) or by primary control the flow (L2). Further examples of known solutions are evident from SE 523 292 where a device (15) controls the induction ratio, i.e. how large the air flow (L2) is going to be, that has to cooperate with the flow of fresh air (L1) and this ratio is controlled by a pivoting regulating disc (150).

In constructions according to the example FI 2006 00 35 there is problem that the air flowing out to the room vary in an uncontrolled way.

In the above constructions different designs of the holes, through which the supply air passes, exists, and where the air flow after those holes makes the condition for the recirculating room air to reach a mixing zone where both air flows are brought together before they flows out to the room where the comfort shall be prevailed. In those constructions the flow out of the pressure chamber to some form of mixing chamber is controlled by a number of holes which are throttled to different forms or to different throats by displacement of discs or the like and where those holes or throats therefore results in that the flow area get all imaginable designs, at the same time as the air flow after those makings of holes acquires undefined directions with risks of sound and different mixing ratios between the amounts of supply air and recirculations, than desirable.

SUMMARY OF THE INVENTION

In the present invention the device has well defined conditions regarding to the flow of supply air from a pressure chamber via a mixing chamber out to the room and consequently those working forces making the recirculation of the room air. There are no extra throttling of the air flows and accordingly a system is obtained where the pressure levels in the supply air system is held down, and accordingly a system is created which means low energy consumption to fulfill the functional demands that exists in the individual case, in the individual installation. Those well defined conditions are obtained by that:

- it always is the same number of openings for the supply air from the pressure chamber into the mixing chamber
- the placing of the openings in the pressure chamber is always the same in relation to the cooling or heating coil and to the mixing chamber
- the entire area on the exposed openings vary in certain steps by that the individual dimension of the openings are varied
- that the individual openings always has a certain form, preferably round
- that the direction of the flow of the air outwards always is the same out of the pressure chamber.

The thoughts and the object of the present invention is therefore to eliminate the disadvantages of the constructions of today as the same time as it brings the technique forwards. Further characteristics and advantages of the invention are evident from the following description with reference to the attached figures, which shows a preferred, but not limiting embodiment of the invention.

BRIEF DESCRIPTION OF THE DRAWINGS

In detail represents in diametric, partly schematic cross sections or perspective views.

DETAILED DESCRIPTION OF THE PREFERRED EMBODIMENTS

Figure 1:
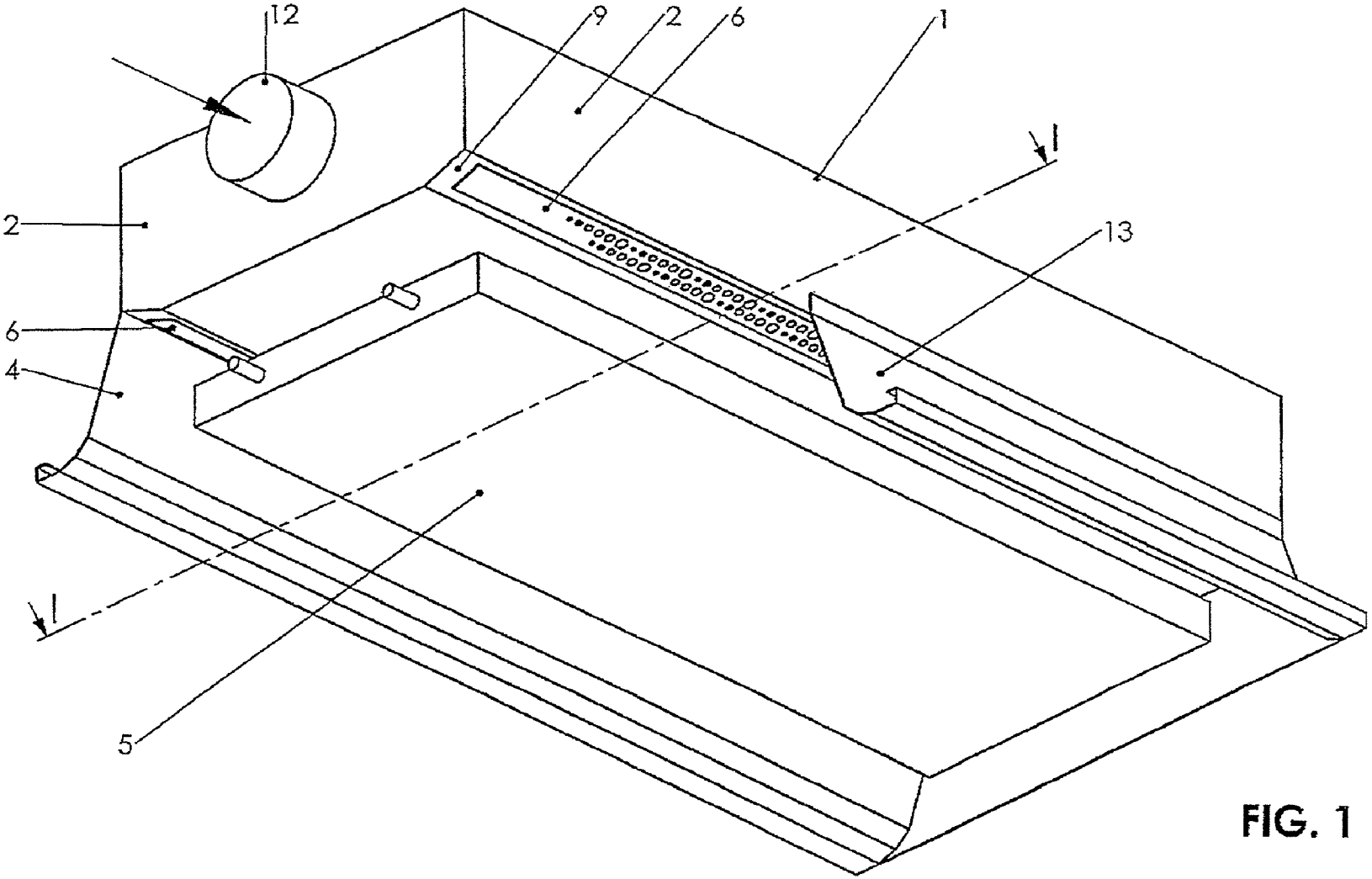
FIG. 1 an overall view of a complete cooling beam.

FIG. 1 shows an example of how a complete cooling beam is constructed. In the figure is shown in a schematic axonometric view a complete cooling beam 1 with a pressure chamber 2, a mixing chamber 4, a cooling/heating coil 5, and regulating strips on both sides of the pressure chamber 4, and side plates 13. Additionally a connection 12 for the supply air into the pressure chamber 2 is shown in FIG. 1.

In a final montage/installation position the complete cooling beam is provided with some form of raster which covers the bottom surface downwards to the room where the cooling beam is mounted. The design of the raster or the design of the side plates and of the outlet zones 10 and 11 respectively is not considered in this application, because they are well known constructions.

Figure 2:
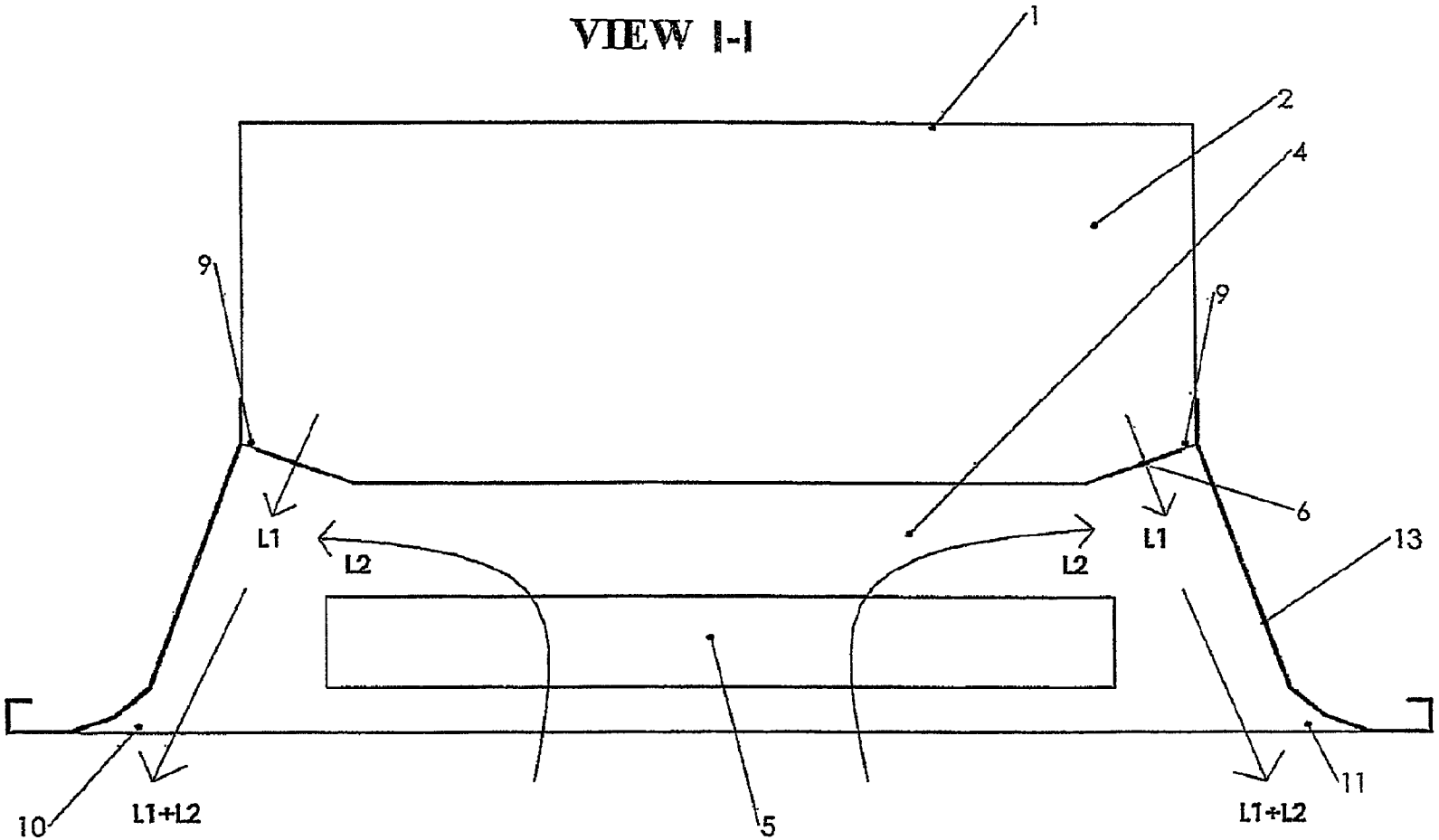
FIG. 2 a schematic section through the cooling beam.

FIG. 2 shows in a sectional view from FIG. 1. In this FIG. 2 the flowing paths for the supply air L1 and for the recirculating room air L2 appears schematically. L1 flows out from the pressure chamber 2 via openings 7 in a regulating strip 6 and where those openings 7 cooperate with holes 3 made in the surfaces 9 in the pressure chamber 2. The regulating strip is mounted on the surfaces 9 in the pressure chamber. The surfaces 9 are preferably oblique in approved angles which means that the air flow L1 out from the pressure chamber gets a direction which results in optimal ejector action on the air flow L2 at the same time as well defined flow profiles are obtained in the complete air flow at L1 and L2 and this independently of the volume flow at L1 and L2. Thanks that the L1-flow is directed in a approved way and that the flow pattern in the mixing chamber 4 is stabile independently of the complete volume flow of L1 and L2 it has been created a flow pattern in the mixing chamber that means that the air flow L2 through the cooling/heating coil 5 is equal large over the entire projected cooling/heating, from air contacted, surface of the coil. This means that the cooling/heating coil 5 is getting an improved output in relation to a coil with the same geometrical design, but where the velocity profile of the air flow is not unitary, not equal over the entire cooling/heating surface.

Figure 3A:
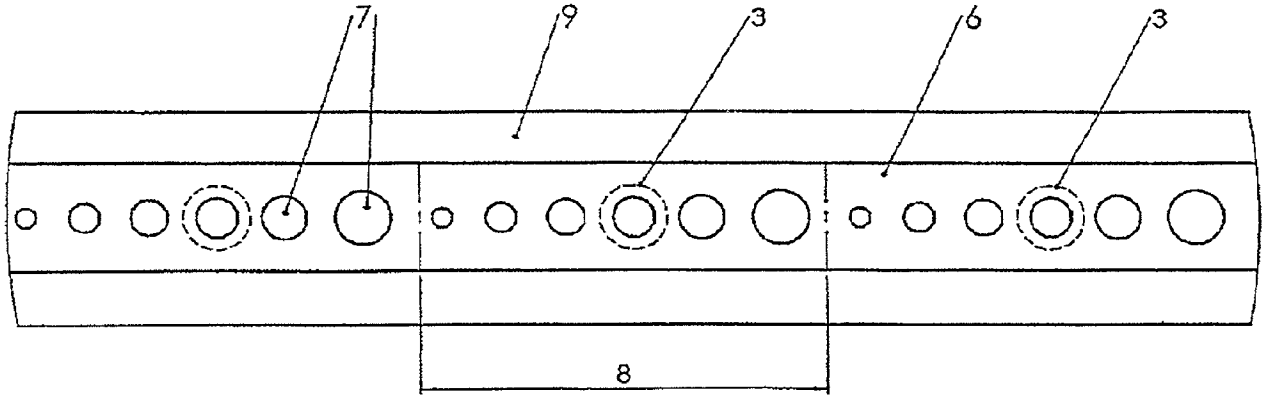
FIGS. 3*a* and 3*b* are regulating strips in some different working positions, FIG. 4 an alternative designed regulating strip.
Figure 3B:
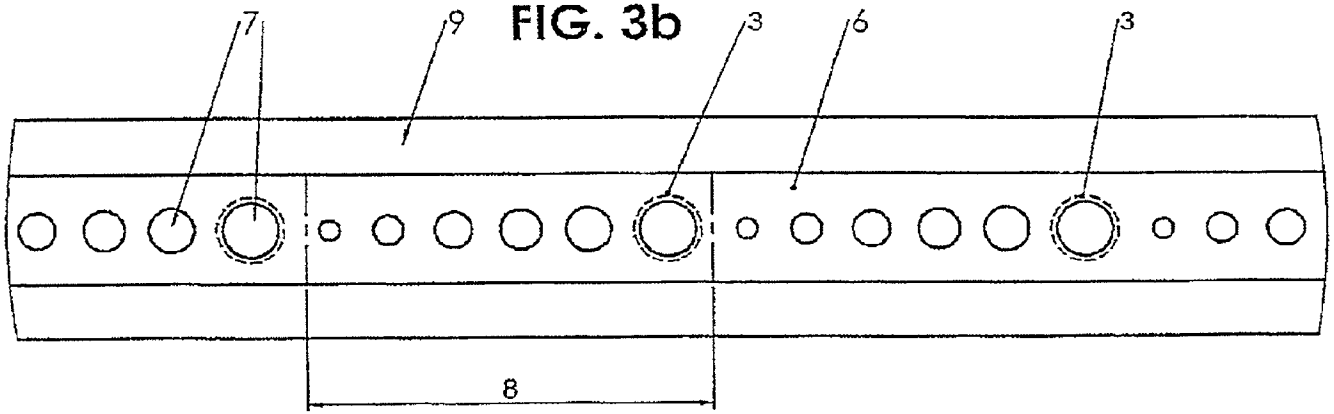

FIGS. 3*a*, 3*b* show principally how the regulating strip 6 is designed and how the openings 7 are constructed and orientated.

In FIGS. 3*a* and 3*b* the regulating strip 6 is designed with a row of openings 7.

Common for the construction is that the regulating strip 6 is displaceably mounted on the surface 9 of the pressure chamber 2. In the surface 9, a number of holes 3 are made. The number of holes is coordinated with the regulating strip and its dimensions. The regulating strip is naturally adapted to the range of the need of air for which the respective cooling beam in its entirety is dimensioned. The construction is based on that the regulating strip 6 has a number of, preferably 6 openings 7, and where those openings are orientated in groups 8. Accordingly each group has 6 openings, preferably placed on one and the same centerline and where the dimensions of the openings is different, from a smallest to a largest one. In the figures, the openings 7 are marked as circular holes, but the geometrical form can of course vary within the frames of the invention, as well as the placement of the openings in relation to a centerline, as well as their number within the respective group and the mutual dimension of the openings 7. Every group 8 recurs in the longitudinal direction of the pressure chamber 2 with a certain approved frequency.

The holes 3 in the surface 9 lies naturally coordinated with the geometrical design that is applied to the regulating strip 6 and its openings 7. The holes 3 in the surface 9 have at least the same dimension as the largest opening 7 and it exists a hole in the surface 9 per each group 8. Consequently the holes 3 recur in the longitudinal direction of the pressure chamber 2 with the same frequency as the groups 8 in order to be coordinated with the positions of the openings 7 and consequently to care for that it always is the same number of openings/holes for the supply air from the pressure chamber into the mixing chamber and that the placing of which always is the same in relation to the cooling/heating coil and to the mixing chamber. Taken together, the approved angle of the surface together with the approved position and the recurring frequency of the holes/openings for the out flowing supply air L1 from the pressure chamber into the mixing chamber results in that an optimal induction effect is secured, with optimal utilization of the entire cooling/heating coil towards the projected area of the room, along the whole length of the cooling beam, independent of the existing dimensions of the openings 7. When the regulating strip 6 is displaced, manually or via some kind of actuator, the openings 7 consequently will be displaced, so that, as is shown in the example of FIG. 3*a*, a "medium-sized" opening uncover a passage for the supply air L1 to flow out of the pressure chamber 2 into the mixing chamber 4. In FIG. 3*b*, the largest opening 7 in every group has uncovered the air passage. In this way different grades of openings are obtained from the pressure chamber 2 to the mixing chamber 4.

Figure 4:
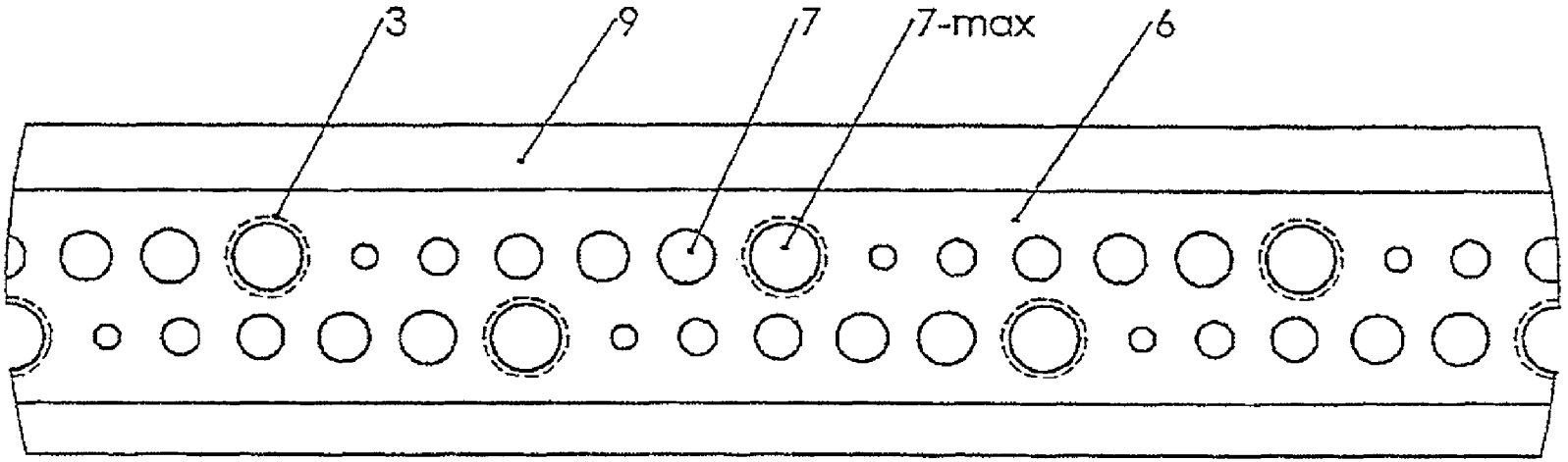

FIG. 4 shows a regulating strip 6 with two rows of openings 7. Naturally the number of rows can be chosen within the frame of the invention.

A further possibility to regulate the flow L1 is obtained in the case when the regulating strip 6, which is individually displaceable in relation to the holes 3 in the surface 9, on one side of the complete cooling beam 1, is displaced so that for example the largest opening 7, as is shown in FIG. 3*b* uncover the air passage for L1, as the regulating strip on the other side of the pressure chamber only is opened as is shown in FIG. 3*a*. This possibility means that the air flow L1+L2 in, for example, the outlet zone 10 in FIG. 2 is getting larger than the flow in the outlet zone 11. This flow regulating technique is useable when the complete cooling beam is mounted closer to a wall than another one, or in the case when one wishes to direct the air flow in the room in another direction.

PARTS LIST

1 complete cooling beam
2 pressure chamber
3 hole
4 mixing chamber
5 cooling/heating coil
6 regulating strip
7 opening
8 group
9 surface
10 outlet zone
11 outlet zone
12 connection
13 side plates

The invention claimed is:

1. A device for a complete cooling beam (1) of an air handling system in which the cooling beam has a pressure chamber (2) with holes (3) through which supply air (L1) flows out to a mixing chamber (4) to which recirculating air (L2) from a room also flows via a cooling/heating coil (5), where the recirculating air (L2) is mixed with the supply air (L1) whereupon the cooled or heated recirculating air (L2) together with the supply air (L1) flows out to the room, the amount of the supply air (L1) being regulated by a displaceable regulating strip (6) having a number of openings (7) that are orientated into groups (8) where the openings (7) in each of the groups (8) has different dimensions and where, in a surface (9) of the pressure chamber (2) lying under the regulating strip (6) there is the hole (3) for every group (8) of the regulating strip (6) and when the displaceable regulating strip (6) is biased to a position such that a chosen opening (7) is coordinated with the hole (3) of the surface (9), always the same number of openings (7) are uncovered/opened from the pressure chamber (2) to the mixing chamber (4) and the openings (7) always have the same placement and an axial center line of each of the openings is aligned in the same direction relative to the cooling/heating coil (5) and relative the mixing chamber (4), and the openings (7) in the regulating strip (6) and the holes (3) in the surface (9) are placed along the whole length of the mixing chamber (4) and since the surface (9), and consequently the regulating strip (6), has a sloping direction in relation to the cooling/heating coil (5), a defined air flow ratio for the supply air (L1) and for the recirculating air (L2) is obtained.

2. The device according to claim 1, wherein the holes (3) in the surface (9) of the pressure chamber (2) have substantially the same dimension as the largest opening (7) in the regulating strip (6).

3. The device according to claim 1, wherein the flow of the supply air (L1) by volume is regulated by displacing the regulating strip (6), either manually or by an actuator, in a way that either a larger or a smaller opening (7) in each group (8) of the regulating strip (6) cooperates with the holes (3) and as a result a new flow of supply air (L1) is obtained, still with the same number of openings (7) opened from the pressure chamber (2) to the mixing chamber (4).

4. The device according to claim 1, wherein the openings (7) are circular.

5. The device according to claim 1, wherein the openings (7) in the regulating strip (6) are successively dimensioned from a smallest to a largest and the number of groups (8) are varied according to either dimensions of the individual installation or a need for supply air.

6. The device according to claim 1, wherein the location of the regulating strip (6), in relation to the mixing chamber (4), and the design of the openings (7) in the regulating strip provide the supply air (L1) with a flow pattern in the mixing chamber that leads to a flow of recirculating air (L2) through the cooling coil (5) receiving the same velocity profile over all of the projected surface of the cooling coil to optimize the thermal features of the cooling coil.

7. The device according to claim 1, wherein a combined volume flow of the supply air and the recirculating air (L1+L2) in a first outlet zone (10) of the complete cooling beam (1) is larger than a combined volume flow of the supply air and the recirculating air (L1+L2) in a second outlet zone (11) because the regulating strip (6) in that part of the mixing chamber (4) which is placed closest to the first outlet zone (10) has a control position that uncovers a larger flow area from the pressure chamber out to the mixing chamber (4) than the regulating strip closest to the second outlet zone (11) does.

8. An air handling system comprising:

a complete cooling beam (1) comprising a pressure chamber (2) having a connection (12), through which supply air (L1) is introduced into the pressure chamber (2), and longitudinally extending surfaces (9) having a plurality of holes (3) through which the supply air (L1) is exhausted from the pressure chamber (2) and flows into a mixing chamber (4);

a longitudinally extending air cooling/heating coil (5) being aligned with and spaced from the pressure chamber (2), an area located at least between the air cooling/heating coil (5) and the pressure chamber (2) being defined as the mixing chamber (4), recirculating air (L2) from a room, in which the air handling system is located, passes through the air cooling/heating coil (5) and being either cooled or heated so that the recirculating air (L2) mixing with the supply air (L1) in the mixing chamber (4);

regulating strips (6) overlaying the surfaces (9) of the pressure chamber (2), each regulating strip (6) having a plurality of openings (7) which are arranged into a plurality of groups (8), the openings (7) of each group (8) having different dimensions, the plurality of openings (7) of the regulating strip (6) being longitudinally aligned with the plurality of holes (3) of the surfaces (9) of the pressure chamber (2) such that each hole (3) corresponds with one group (8) of openings (7);

the regulating strips (6) being longitudinally movable with respect to the surfaces (9) of the pressure chambers (2) between a plurality of set positions, in each set position each of the holes (3) of the surface (9) is coaxially aligned with a selected one of the openings (7) of the corresponding group (8);

the selected openings (7) having a common dimension such that the flow of the supply air (L1) from the pressure chamber (2) through each of the holes (3) and the selected openings (7) is the same so as to facilitate regulation of a ratio of the supply air (L1) to the recirculating air (L2) in the mixing chamber (4); and longitudinally extending side plates (13) being fixed to the pressure chamber (2) to form outlets zones (10, 11) through which the mixed supply air (L1) and the recirculating air (L2) is exhausted from the air handling system.

* * * * *